US005714051A

United States Patent [19]

Van Leth et al.

[11] Patent Number: 5,714,051

[45] Date of Patent: Feb. 3, 1998

[54] METHOD FOR DEPOSITING CATHODE MATERIAL ON A WIRE CATHODE

[75] Inventors: Nicolaas J.M. Van Leth; Godefridus J. Verhoeckx; Theodorus H.M. Stevens, all of Eindhoven, Netherlands

[73] Assignee: U.S. Philips Corporation, New York, N.Y.

[21] Appl. No.: 635,342

[22] Filed: Apr. 19, 1996

[30] Foreign Application Priority Data

May 2, 1995 [EP] European Pat. Off. ..... 95201137

[51] Int. Cl.[6] ..... C25D 7/06; C25D 13/16; H01J 9/04

[52] U.S. Cl. ..... 205/122; 204/206; 204/224 R; 204/471; 204/512; 204/623; 205/128; 205/129; 205/136; 205/137; 205/138

[58] Field of Search ..... 205/118, 122, 205/128, 129, 136, 137, 138; 204/471, 499, 512, 206, 224 R, 623

[56] References Cited

U.S. PATENT DOCUMENTS

| | | | |
|---|---|---|---|
| 1,773,135 | 8/1930 | Flanzer | 205/122 X |
| 2,445,372 | 7/1948 | Trenbath | 205/138 X |
| 3,977,957 | 8/1976 | Kosowsky | 205/129 X |
| 4,100,449 | 7/1978 | Gange | 313/337 |
| 4,487,673 | 12/1984 | Steinmetz | 204/181 R |

FOREIGN PATENT DOCUMENTS

| | | |
|---|---|---|
| 874337 | 4/1953 | Germany . |

*Primary Examiner*—Bruce F. Bell
*Assistant Examiner*—William T. Leader
*Attorney, Agent, or Firm*—Robert J. Kraus

[57] ABSTRACT

A method and apparatus for depositing emitter material (3) on a wire cathode by means of electrodeposition. An amount (13) of a suspension comprising an alkaline-earth compound is transferred by a drop holder (11) which is positioned around the wire (2), by movement in a direction transverse to a longitudinal axis of the wire (2), whereafter an electric voltage is applied to the drop holder (11) and the wire (2) to deposit the emitter material (3) on the wire (2), after which the drop holder (11) is withdrawn from the wire (2) again. During the electrodeposition process the drop holder (11) and the wire (2) can be moved with respect to each other along sections of the wire (2) where the emitter material (3) has to be deposited.

10 Claims, 3 Drawing Sheets

METHOD FOR DEPOSITING CATHODE MATERIAL ON A WIRE CATHODE

BACKGROUND OF THE INVENTION

The invention relates to a method for manufacturing a wire cathode covered with an emitter material, in which method a material is deposited on a wire by means of electrodeposition.

The invention also relates to an apparatus for depositing an emitter material on a wire, said apparatus comprising a means for holding the wire, a drop holder comprising a suspension and means for applying an electric potential to the wire and the drop holder.

Wire cathodes are used for instance in flat electroluminescent picture display devices such as flat CRTs, or in lamps.

It is known to manufacture wire cathodes by means of a method in which an emitter material is deposited on a wire by means of electrodeposition. Such a method is known, e.g. from German Patent No. 874.337. In said method, a wire cathode wound on a reel is passed through a suspension in which an alkaline-earth metal compound is dispersed, which compound is electrodeposited on the wire. To enable electrodeposition, the wire is used as a cathode, while a pipe of metallic material, which is connected to a supply pipe to continuously provide the pipe with the suspension, is used as an anode. The cylindrical pipe forms an electrophoretic cell through which the wire is led. The movement of the cathode wire through the electrophoretic cell is temporarily interrupted at the sections of the wire that need to be coated whereupon the polarisation voltage is switched on and the electrophoretic process is started. Once the cathode wire is provided with the desired coating, the polarisation voltage is switched off again and transport of the wire is resumed until the next section of the wire to be coated is positioned in the electrophoretic cell. Eventually, the coated cathode wire is wound on a second reel.

A disadvantage of the known method is that undesired deposits are obtained on those parts of the cathode wire that need not be coated. In operation, this leads to electron emission on parts of the wire where it is not desired. Furthermore, soldering of the wire to connection means is adversely affected by such unwanted deposits.

It is an object of the invention to provide a method for depositing an alkaline-earth metal compound on a wire cathode in which one or more of the above cited problems are obviated or at least alleviated.

For this purpose a method of the type described in the opening paragraph is characterized in that a suspension comprising the material is transferred by a drop holder, which is positioned around the wire, by movement in a direction transverse to a longitudinal axis of the wire, whereafter an electric voltage is applied to the drop holder and the wire to deposit the emitter material on the wire, after which the drop holder is withdrawn from the wire again.

In the known method it is required that all parts of the wire pass through the electrophoretic cell, including those parts which need not be coated. This implies that all parts of the wire are in contact with the suspension for a certain period of time, leading to undesired deposits on those parts of the cathode wire that need not be coated. Apart from the above-mentioned problem of unwanted deposits, this also leads to an early depreciation of the suspension or unwanted changes in the composition of the suspension requiring frequent renewal of the solution.

SUMMARY OF THE INVENTION

The method according to the invention enables the parts of the wire on which the material is electrodeposited to be very accurately determined. All the parts of the wire that do not require a coating are not brought into contact with the suspension, so that said parts of the wire remain pristine as they do not contain residues of the suspension nor any coating material. Thus, the amount of electrodeposition solution used is minimal.

Another consequence of the invention is that the drop holder and the container holding the bulk suspension are physically separated from each other. This precludes any pollution of the container holding the bulk suspension with reaction products in the drop holder. The physical separation of the drop holder and the bulk container also enables the container holding the bulk suspension to be stirred continuously, without any adverse effects on the deposition process. Such stirring extends the useful life of the solution. It is also more easier to prevent dust or particles from falling in the solution. Even the smallest particle adhering to the wire can seriously impair the local emission of the wire cathode. Furthermore, the solution in the container itself is not or hardly contaminated by any reaction products. Should it be necessary to remove reaction products, this can very easily be done by shaking the drop holder or container, so that the "contaminated drops" fall off and new uncontaminated drops are formed. An optimal use can thus be made of the suspension. Since such electrodeposition solutions often comprise environmentally harmful materials, it is very advantageous to optimally using the solution.

In addition, if heating of the suspension is required to provide for optimum electrodeposition conditions, not the entire suspension in which the alkaline-earth metal compound is dispersed has to be maintained at an elevated temperature but only the amount of the suspension comprising the material held by the drop holder which is positioned around the wire has to be heated.

Preferably, the method of the type described in the opening paragraph is characterized in that during the deposition process the drop holder and the wire are moved with respect to each other along parts of the wire where the emitter material has to be deposited. By moving the drop holder and the wire with respect to each other the homogeneity of the deposited layer can be further improved.

A preferred embodiment of the invention is characterized in that a number of wires are arranged substantially parallel to each other and are provided with the emitter material substantially simultaneously. By aging a number of cathode wires parallel to each other, the speed of the coating process can be considerably increased.

Another preferred embodiment of the invention is characterized in that a comb of drop holders is used. By using a comb of drop holders instead of a single drop holder, the efficiency of the coating process can be substantially improved. In addition, if a coating is required only on a limited number of sections of one cathode wire, these sections can be coated in a single operation.

Another preferred embodiment of the invention is characterized in that prior to the deposition process, the wire is welded to two conducting end pieces. Normally, reels and/or rollers are employed to stretch the cathode wire, which may result in unwanted damage to the coated wire especially if a pair of rollers moves over the freshly coated wire passes or if said wire is bent over a reel. By welding or soldering end pieces to a (section of) cathode wire, these end pieces can be used to hold the cathode wire during the electrodeposition process. The end pieces can also be used to easily apply an electric potential to the wire cathode. Due to the coating process according to the invention, the end pieces of the cathode wire remain completely free of (residual) coating material.

For certain applications, it is advantageous if two or more cathode wires which are arranged parallel to each other are welded to common end pieces. Said two or more cathode wires can be coated separately or simultaneously with emitter material.

A preferred embodiment of the method in accordance with the invention is characterized in that the material comprises an alkaline-earth compound. Alkaline-earth compounds deposited on wire cathodes improve the emissive characteristics of the wire.

An apparatus of the type described in the paragraph following the opening paragraph is characterized in that the apparatus also comprises a means for positioning the drop holder around the wire by a movement transverse to the longitudinal axis of the wire.

Preferably, the apparatus is characterized in that it also comprises a means for moving the drop holder and the wire with respect to each other along parts of the wire where the emitter material has to be deposited.

A further preferred embodiment of the apparatus in accordance with the invention is characterized in that the drop holder is in the form of a keyhole with an open bottom side. A drop holder in the form of a keyhole with an open bottom side is very suitable for holding an amount of the suspension and enables easy insertion of the wire into the drop holder. The converging ends of the drop holder enable the wire to be easily guided into the drop holder.

BRIEF DESCRIPTION OF THE DRAWING

These and further aspects of the invention will be explained in greater detail by means of exemplary embodiments and with reference to the accompanying drawing, in which.

The Figures are purely diagrammatic and not drawn to scale. In general, like reference numerals refer to like parts in the Figures.

DESCRIPTION OF THE PREFERRED EMBODIMENTS

Figure 1:
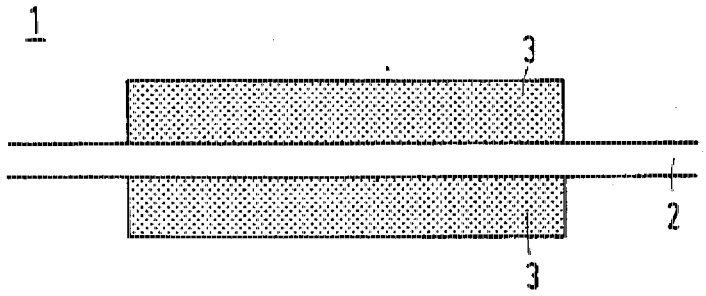
FIG. 1 shows a cross-section of a coated wire cathode.

FIG. 1 shows a wire cathode 1. The wire cathode comprises a wire 2, usually made from a refractory metal, such as tungsten, molybdenum or alloys comprising such metals. The wire may additionally comprise other elements to improve certain properties, such as the strength of the wire, or to increase the emission. A coating of an emissive material 3 is provided or, the wire 2. Typically, such a coating comprises an alkaline earth metal oxide or a mixture of alkaline earth metal oxides, and it may also comprise other constituent elements or oxides, for instance rare-earth oxides, to improve a certain characteristic, such as the emission, of the wire cathode.

Figure 2A:
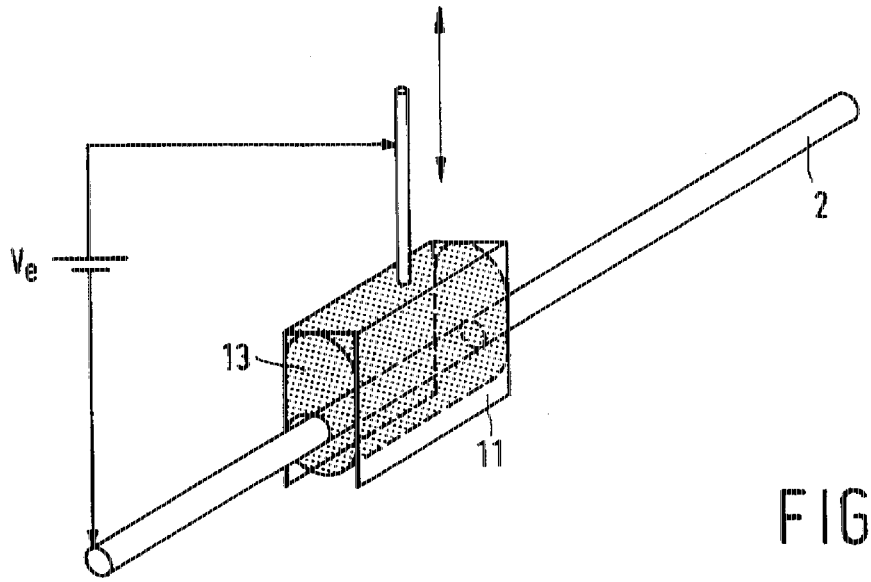
FIG. 2A illustrates in a perspective view a drop holder containing an amount of the suspension during electrodeposition on a selected part of a wire cathode and FIG. 2B shows the resulting, coated wire cathode.
Figure 2B:
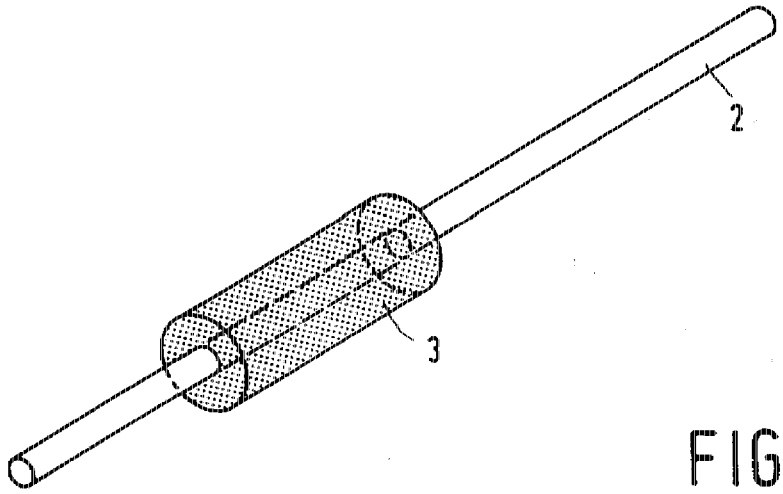

FIG. 2A illustrates in a perspective view an example of the method according to the invention. An amount 13 of a suspension comprising an alkaline earth metal compound hangs from drop holder 11. An amount 13 is extracted from a container holding the bulk of the suspension (not shown in FIG. 2). The drop holder 11 is positioned around (a clean part of) the wire 2 by movement in a direction transverse to the longitudinal axis of the wire 2 (the movement is indicated by the vertical arrow in FIG. 2A). The drop holder 11 is in position if the part of wire 2 to be coated is completely immersed in the amount 13 of the suspension. Between the drop holder 11 and the wire 2 a voltage $V_e$ is applied to electrodeposit emitter material 3 on those parts of the wire that are in the amount 13 of the suspension. The amount of deposited material 3 can be very accurately determined by the time during which the voltage difference is applied. Once the desired layer is deposited on the cathode wire 2, the voltage supply is switched off and the drop holder 11 is withdrawn from the wire 2 by moving it in a direction transverse to the longitudinal axis of the wire 2. The resulting layer of emissive material 3 deposited on cathode wire 2 is shown in FIG. 2B.

Figure 3:
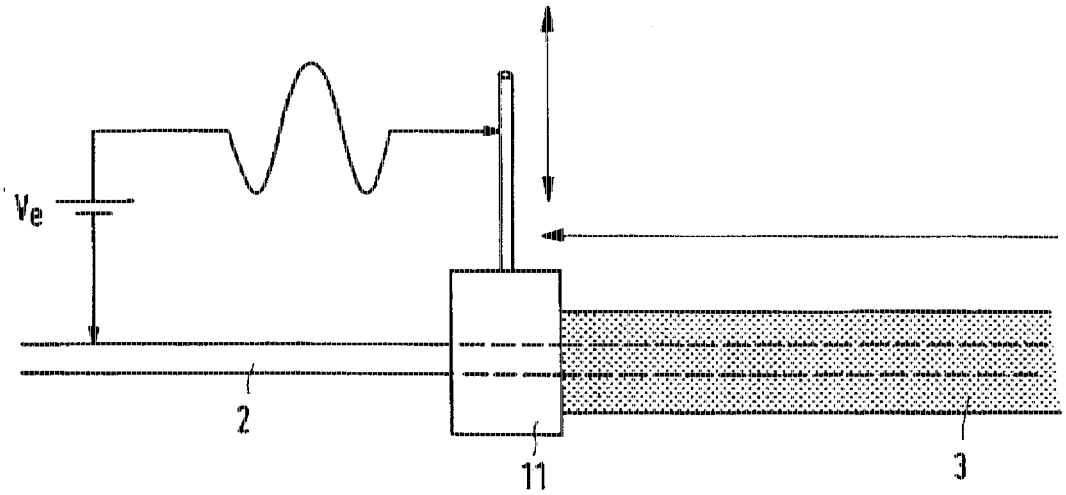
FIG. 3 shows a cross-section of a wire cathode during a coating process in which the drop holder is moved along the wire.

FIG. 3 is a cross-sectional view of another example of the method according to the invention. Before the coating process is started the drop holder 11 containing an amount 13 of the suspension is positioned around the wire 2 by moving it in a direction substantially perpendicular to the longitudinal axis of the wire 2 (the movement is indicated by the vertical arrow in FIG. 3). Subsequently, a voltage $V_e$ (by means of flexible wires) is applied between the drop holder 11 and the wire 2 to electrodeposit emitter material 3 on the wire whereafter the wire 2 and the drop holder 11 are moved with respect to each other. In FIG. 3, a situation is shown in which the drop holder 11 containing the amount 13 of the suspension is moved along the wire 2 (the movement is indicated by the horizontal arrow in FIG. 3). The amount of deposited material 3 as well as the sections of the wire 2 on which the emissive material 3 is deposited can be very accurately determined by the time during which the voltage difference $V_e$ is applied, by the speed with which the amount 13 of the suspension is provided on the wire and by the voltage difference $V_e$. Each time a fresh amount 13 of the suspension can be extracted from the container holding the bulk of the suspension (not shown in FIG. 3). When the coating process is finished, the voltage supply is switched off and the drop holder 11 is withdrawn from the wire 2 by moving it in a direction transverse to a longitudinal axis of the wire 2.

Figure 4:
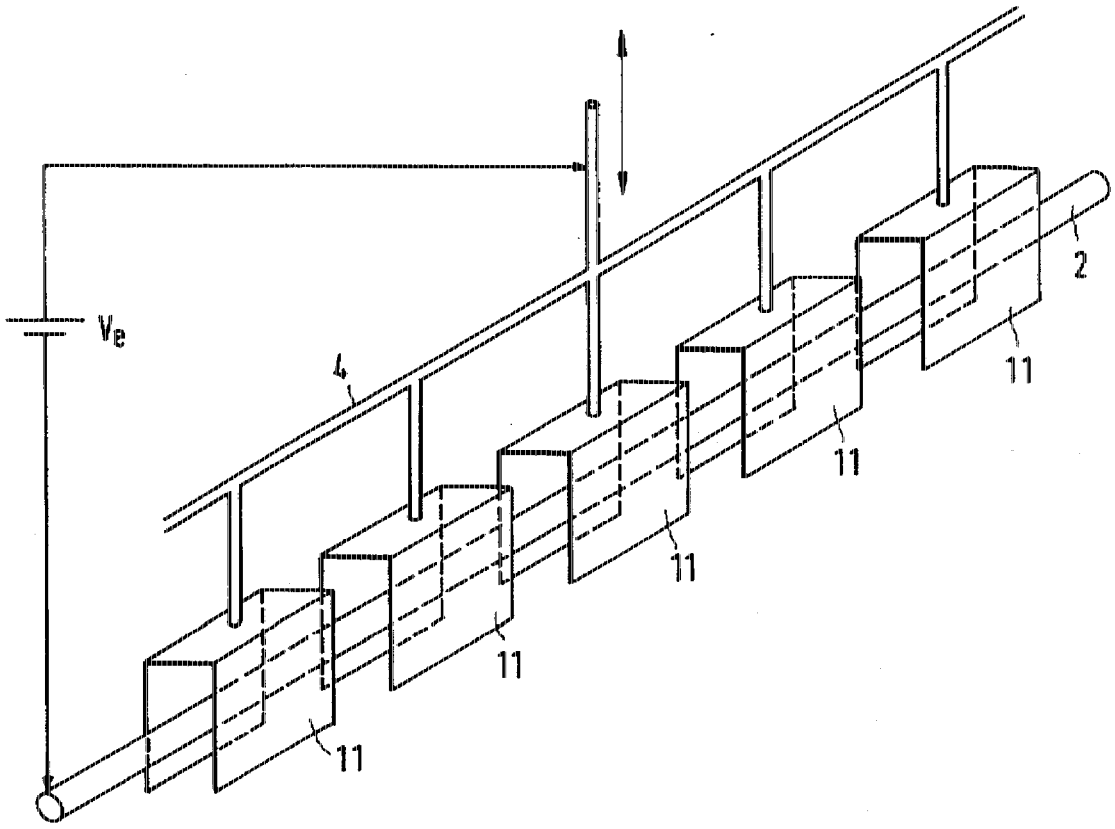
FIG. 4 illustrates in a perspective view the simultaneous coating of a cathode wire with the aid of a comb of drop holders.

FIG. 4 is a perspective view of another example of the method according to the invention. Instead of a single drop holder 11 a set of drop holders 11 arranged on a comb 4 are employed in order to simultaneously coat several parts of a cathode wire 2. This can be advantageous if only certain predetermined parts of the wire 2 need to be coated. The comb 4 of drop holders 11, each drop holder 11 containing an amount 13 of the suspension, is positioned around the wire 2 by moving it in a direction substantially perpendicular to the longitudinal axis of the wire 2 (the movement is indicated by the vertical arrow in FIG. 4). If desired, the comb of drop holders can be moved along the wire. The individual drop holders 11 can be arranged with great freedom relative to the comb 4. In the example shown in FIG. 4, all drop holders are arranged in a direction along the longitudinal axis of wire 2 and the drop holders 11 are mounted at the same distance from to the comb but, if desired, the distance between the drop holders 11 and the comb may be different. Moreover, a comb 4 of drop holders 11 which are arranged along the direction transverse to the longitudinal axis of the wire 2 can be useful to simultaneously coat a number of cathode wires 2 which are arranged substantially parallel to each other. By arranging several drop holders or combs of drop holders parallel to each other, it is possible to simultaneously coat numerous parts of a number of wires which are arranged substantially parallel to each other.

Figure 5:
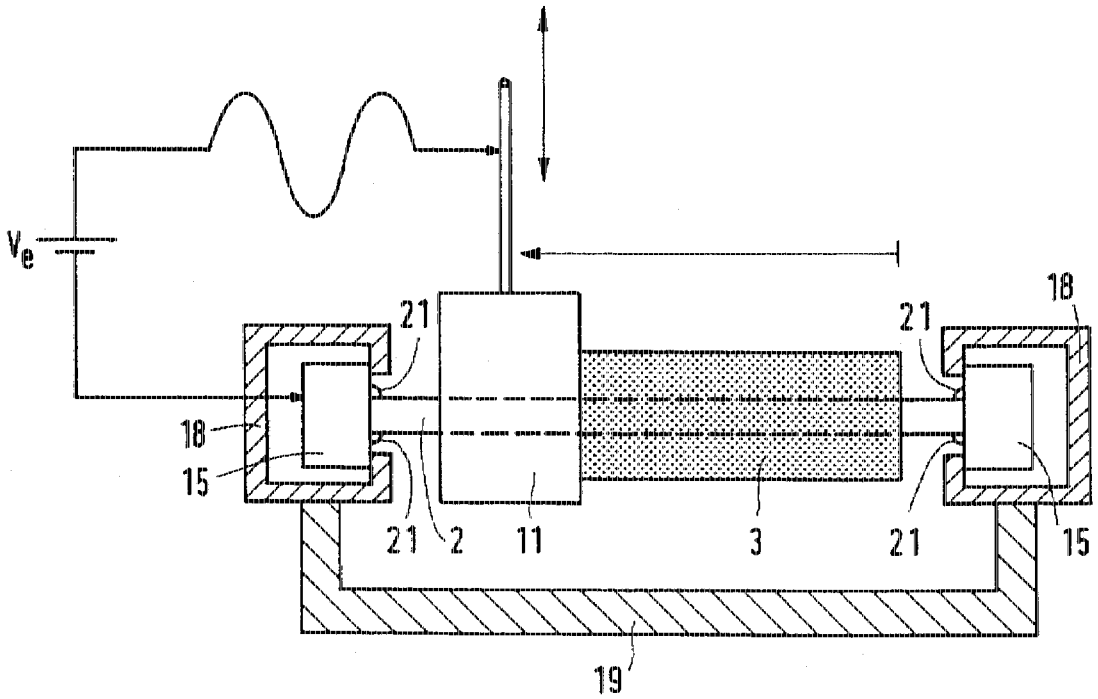
FIG. 5 shows a cross-section of a portion of a cathode wire having two end pieces during a coating process in which the drop holder is moved along the wire.

FIG. 5 is a cross-sectional view of another example of the method according to the invention. A section of cathode wire 2 which is provided at both ends with an end piece 15 which are welded or soldered by means of the joints 21 to the section of wire 2. These two end pieces 15 are employed to hold the wire 2 and to connect the wire to the desired voltage supply $V_e$. Two clamping means 18 connected to a support 19 (means 18 and support 19 are shown very schematically in FIG. 5) are used to hold the wire 2 by the end pieces 15. Once the drop holder 11 containing an amount 13 of the suspension is positioned around the wire and the voltage supply $V_e$ is switched on the coating process starts. During coating, the drop holder 11 and the wire 2 can be moved with respect to each other. In the example of FIG. 5, the drop holder 11 is moved along the wire 2, leaving a coating 3 on the wire 2. Due to the coating method according to the invention, the end pieces 15 of the wire 2 remain completely free of any (residual) deposit, so that the solder is not adversely affected by the coating process. In addition, the electrical conductivity of the end pieces 15 of the wire 2 is not adversely affected by the presence of a deposit.

Figure 6:
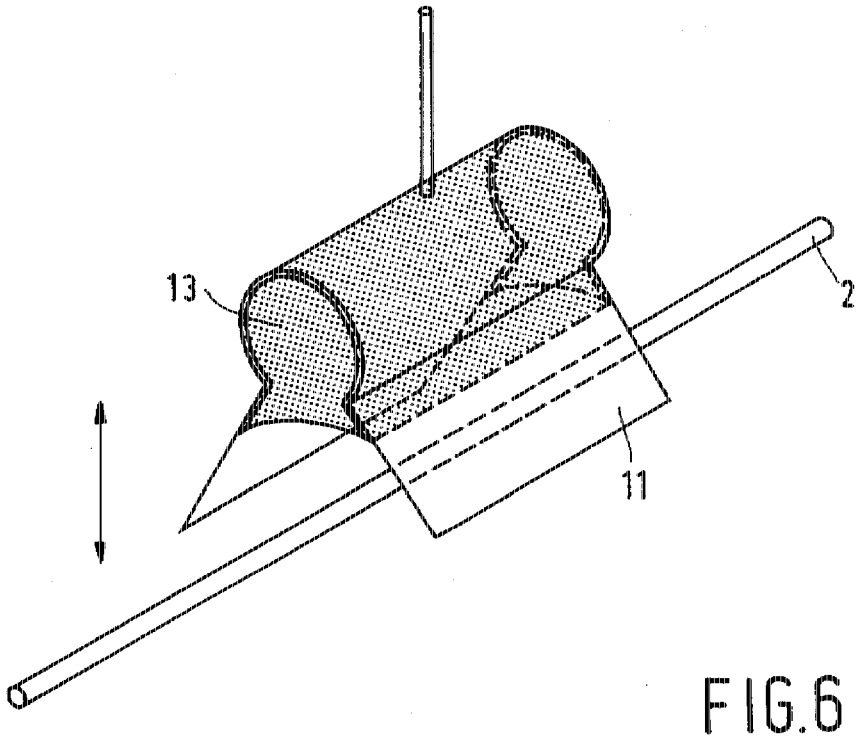
FIG. 6 illustrates in a perspective view a drop holder in the form of a keyhole with an open bottom side, which contains an amount of the suspension.

FIG. 6 is a perspective view of a special embodiment of the drop holder 11 according to the invention. A drop holder 11 in the form of a keyhole with an open bottom side contains an amount 13 of the suspension is very suitable and easy of access for the wire 2, i.e. the wire 2 is easily guided into the drop holder 11 via the converging ends of the drop holder 11.

It will be dear that within the framework of the invention further variations are possible. For instance, it is possible to regulate the temperature of the drop holder. For example, an increase of the temperature of the drop holder, and hence of the temperature of the suspension containing the amount may improve the deposition of the material on the wire. The temperature of the drop holder can be increased and regulated by for instance infrared heating of the drop holder or by induction heating or by heating a wire around the drop holder.

Instead of alkaline-earth metal compound also insulating materials, such as, for example siliconoxide or aluminiumoxide, can be used as coating material.

Instead of obtaining homogeneous coatings with a very uniform thickness, it is also possible to deposit coatings on wire cathodes with a pre-determined non-uniform thickness. By regulating the electrodeposition voltage and/or by regulating the speed of the movement of the wire and the drop holder with respect to each other, the thickness of the deposited material can be varied according to a desired pattern.

In all embodiments of the invention shown, the drop holder was open at the bottom side. It is obvious that the drop holders can be open either at one of the sides or at the top of the drop holder. The suspension adheres to the drop holder by capillary forces and/or by a combination of cohesion and adhesion.

By means of parallel processing, in which two or more parallel wires are electrodeposited simultaneously, the number of wires that can be provided with material is increased.

Also a cathode wire with an helical configuration can be coated by the method and apparatus according to the invention. The longitudinal axis of the wire should then be interpreted not as the axis of the wire itself but as the axis of the helical configuration.

The invention generally relates to a method and apparatus for electrodepositing emitter material on a wire cathode, in which method an amount of a suspension comprising an alkaline-earth compound is carded by a drop holder, which is positioned around the wire, by movement in a direction transverse to the longitudinal axis of the wire, whereafter an electric voltage is applied to the drop holder and the wire to deposit the emitter material on the wire, after which the drop holder is withdrawn from the wire again. During the electrodeposition process, the drop holder and the wire can be moved with respect to each other along sections of the wire where the emitter material has to be deposited.

We claim:

1. A method of electrodepositing a material on a selected portion of a wire, comprising the steps of:

providing a drop holder having opposing ends and one side that are open sufficiently to allow the holder to receive a wire within the holder by laterally moving the holder relative to the wire in a direction transverse to the longitudinal direction of the wire;

receiving into the holder a drop of suspension comprising a material to be electrodeposited, the drop of suspension being held within the holder and not spilling out of the open ends and side thereof due to capillary, cohesion and/or adhesion forces;

moving the holder containing the drop of suspension transverse to the longitudinal direction of the wire to bring a selected portion of the wire into contact with the suspension;

applying an electrical potential between the wire and the suspension to electrodeposit the material in the suspension onto the selected portion of the wire; and then withdrawing the holder from the wire by again moving the holder transverse to the longitudinal direction of the wire.

2. A method according to claim 1 wherein a plurality of drop holders are provided and used simultaneously to electrodeposit the material in parallel onto a corresponding plurality of wires.

3. A method according to claim 1 wherein a plurality of drop holders are provided and used simultaneously to electrodeposit the material in parallel onto a corresponding plurality of spaced apart portions of the wire.

4. A method according to claim 1 wherein the material comprises an alkaline-earth compound.

5. A method according to claim 1 wherein prior to electrodepositing the material onto the wire, the wire is welded to two conducting end pieces.

6. A method according to claim 1 wherein the wire and the holder are moved with respect to each other in the longitudinal direction of the wire along a selected section of the wire while the electrical potential is applied to electrodeposit the material in the suspension onto the selected section of the wire.

7. A method according to claim 6 wherein a plurality of drop holders are provided and used simultaneously to electrodeposit the material in parallel onto a corresponding plurality of wires.

8. A method according to claim 6 wherein a plurality of drop holders are provided and used simultaneously to electrodeposit the material in parallel onto a corresponding plurality of spaced apart portions of the wire.

9. A method according to claim 6 wherein the material comprises an alkaline-earth compound.

10. A method according to claim 6 wherein prior to electrodepositing the material onto the wire, the wire is welded to two conducting end pieces.

* * * * *